US007159826B1

(12) United States Patent
Bruce

(10) Patent No.: US 7,159,826 B1
(45) Date of Patent: Jan. 9, 2007

(54) HOSE CLAMPING DEVICE

(75) Inventor: Terry Bruce, Aberdeen (GB)

(73) Assignee: Kennedys, Glasgow (GB)

( * ) Notice: Subject to any disclaimer, the term of this patent is extended or adjusted under 35 U.S.C. 154(b) by 8 days.

(21) Appl. No.: 10/019,624

(22) PCT Filed: Jul. 6, 2000

(86) PCT No.: PCT/GB00/02576

§ 371 (c)(1),
(2), (4) Date: Dec. 26, 2001

(87) PCT Pub. No.: WO01/02057

PCT Pub. Date: Jan. 11, 2001

(30) Foreign Application Priority Data

Jul. 6, 1999 (GB) ..... 9915653.1

(51) Int. Cl.
*A62C 17/76* (2006.01)
*A47G 29/00* (2006.01)

(52) U.S. Cl. ..... 248/79; 248/80; 248/84; 285/87; 285/91

(58) Field of Classification Search ..... 248/84, 248/75–81, 74.2, 74.3, 79, 82, 83, 122, 128, 248/130, 131, 89–92, 229.13; 285/81, 87, 285/91, 184
See application file for complete search history.

(56) References Cited

U.S. PATENT DOCUMENTS 575,700 A * 1/1897 Charbonneau ..... 248/84
1,444,900 A * 2/1923 Blaw ..... 248/84
1,451,006 A * 4/1923 Blaw ..... 248/84
1,583,772 A * 5/1926 Blaw ..... 248/77
1,667,342 A * 4/1928 Blaw ..... 248/84
1,775,846 A * 9/1930 Blaw ..... 248/82
3,013,755 A * 12/1961 Ittner ..... 248/75
3,603,539 A 9/1971 Clegg
3,645,484 A 2/1972 Itner
3,856,245 A * 12/1974 Byerly ..... 248/74.3
3,916,488 A * 11/1975 Gazda et al. ..... 24/16 R
5,474,369 A * 12/1995 Inagaki et al. ..... 303/146

FOREIGN PATENT DOCUMENTS

GB 13318 * 5/1897
GB 2 326 082 A 12/1998

* cited by examiner

*Primary Examiner*—Carl D. Friedman
*Assistant Examiner*—Tan Le

(57) ABSTRACT

A universal hose clamp includes a universal hose locating mechanism, a hose coupling for connecting a hose to the hose clamp, and securing structure for securing the locating mechanism to a support structure. The universal hose clamp may be employed to secure a hose to an existing support structure or to a portable independent frame. The universal hose clamp is designed to be adaptable for use with a range of hose diameters and as such the universal hose clamp can be employed in a wide range of emergency situations. When deployed the universal hose clamp enables rotating the hose coupling in any direction and thereafter the hose coupling can be locked in that position. Therefore, with the aid of the universal hose clamp only one operator is required to control a hose device in an emergency situation.

16 Claims, 4 Drawing Sheets

HOSE CLAMPING DEVICE

BACKGROUND OF THE INVENTION

1. Field of the Invention

The present invention relates to a device for securing hoses, particularly those used by fire fighters.

2. The Relevant Technology

When fighting a fire there are a number of problems to be addressed in addition to extinguishing the fire, for example rescuing those who are trapped or crowd control. As a result the available human resources need to be carefully targeted to limit/prevent the occurrence of injury.

BRIEF SUMMARY OF THE INVENTION

The present invention recognises that as part of fire-fighting the use and control of a hose is an onerous task requiring the efforts of several people. The present invention attempts to mitigate this problem and allow for better targeting of available resources.

It is an object of the present invention to provide a device whereby a hose can be clamped to a support thus allowing fire fighters to be released from such duties and available for other tasks, for example rescuing those who are trapped.

It is a further object that such a device will be simple to use and readily adapted to the dimensions of different hoses.

According to the present invention there is provided a universal hose clamp comprising a universal hose locating mechanism, a hose coupling for connecting a hose to the hose clamp, and a securing means for securing said locating mechanism to a support structure.

Preferably the support structure is an existing railing, pole or other similar structure.

Preferably the securing means is a universal base clamping mechanism adapted for clamping onto the support structure.

Alternatively the support structure is a portable independent frame.

More preferably the portable independent frame is a tripod.

Preferably in this second embodiment the securing means is a locking mechanism adapted to lockably engage the hose locating mechanism to the support structure, wherein the locking mechanism comprises a male and female member that are adapted to lockably engage.

Preferably the hose locating mechanism comprises a central mount, two azimuth locking mechanisms and a quick release hose mount.

More preferably the azimuth locking mechanism contained on the locating mechanism comprises a handle assembly, a connection means and a stab pin.

Preferably the azimuth locking mechanism contained on the locating mechanism moves between an unlocked position when the handle assembly is in a plane parallel to the stab pin, and a locked position when the handle assembly is rotated through 90 degrees to lie in a plane perpendicular to the stab pin.

Preferably the first azimuth locking mechanism contained on the locating mechanism provides a means for rotating the hose coupling about an axis in the horizontal plane.

Preferably the second azimuth locking mechanism contained on the locating mechanism provides a means for rotating the hose coupling about an axis in the vertical plane.

Preferably the hose coupling comprising a gripping aid, a mounting band and a securing means.

Preferably the gripping aid is cylindrical in shape.

More preferably the gripping aid is made of a flexible material, namely rubber.

Preferably the mounting band is cylindrical in shape.

Preferably the securing means is a screw thread mechanism

Preferably the attachment means for the hose coupling to the universal hose clamp is easily detachable.

More preferably the attachment means is by way of an azimuth locking mechanism.

BRIEF DESCRIPTION OF THE DRAWINGS

In order to provide a better understanding of the invention embodiments will now be described by way of example only with reference to the accompanying Figures in which.

DETAILED DESCRIPTION OF THE PREFERRED EMBODIMENT

Figure 1:
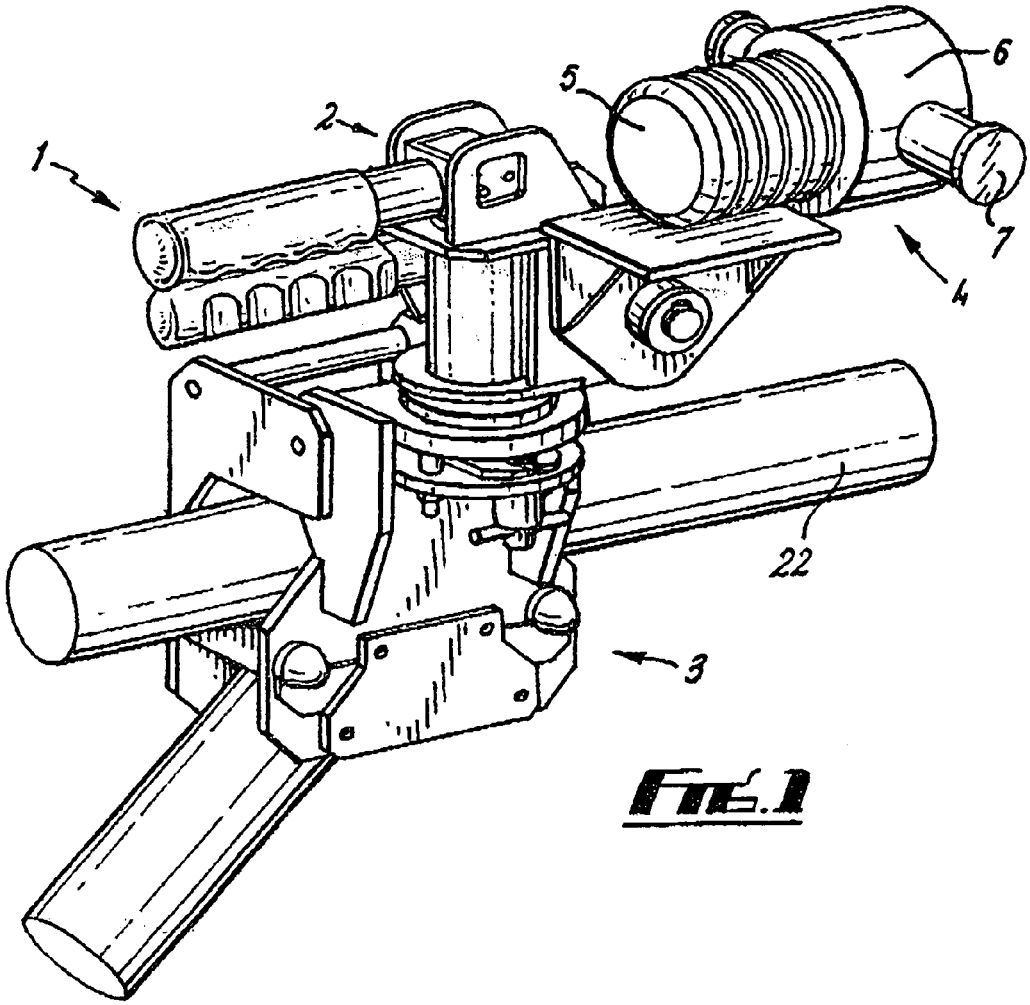
FIG. 1 illustrates a universal hose clamp for locking and securing a hose.

Referring initially to FIG. 1, a universal hose clamp is generally depicted at 1 comprising a universal hose locating mechanism 2, a universal base clamping mechanism 3 and a hose coupling 4.

The hose ccoupling 4 comprises a cylindrical gripping aid 5, a cylindrical mounting band 6 and a screw thread mechanism 7.

Figure 2:
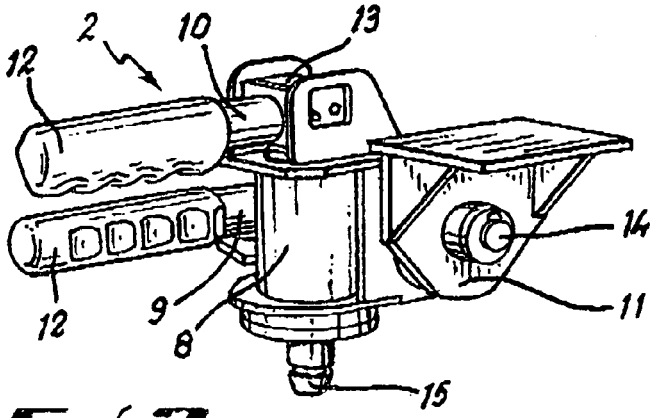
FIG. 2 illustrates a component of the universal hose clamp, namely a universal hose locating mechanism, with two azimuth locking mechanisms shown in a locked position.

FIG. 2 illustrates further detail of the universal hose locating mechanism 2 in the absence of the base claming mechanism 3 and the hose coupling 4. The hose locating mechanism 2 comprises a central mount 8, two azimuth locking mechanisms 9 and 10 and a quick release hose mount 11.

The two azimuth locking mechanisms 9 and 10 further comprise a handle assembly 12, a connection means 13 and a stab pin 14 or 15. The connection means 13 provides the activation mechanism for moving the azimuth locking mechanisms 9 and 10 between their unlocked and locked positions. In FIG. 2 both locking mechanisms 9 and 10 are in their locked positions. When unlocked the first azimuth locking mechanism 9 allows rotation of the hose mount 11, and hence the hose coupling 4, about a horizontal axis while the second azimuth locking mechanism 10, when unlocked, allows rotation about a vertical axis. It should be noted at this point that these two mechanisms lock independently of each other such that one may be in the locked position while the other is in the unlocked position. The stab pins 14 and 15 provide male members for the azimuth locking mechanisms 9 and 10, respectively.

Figure 3:
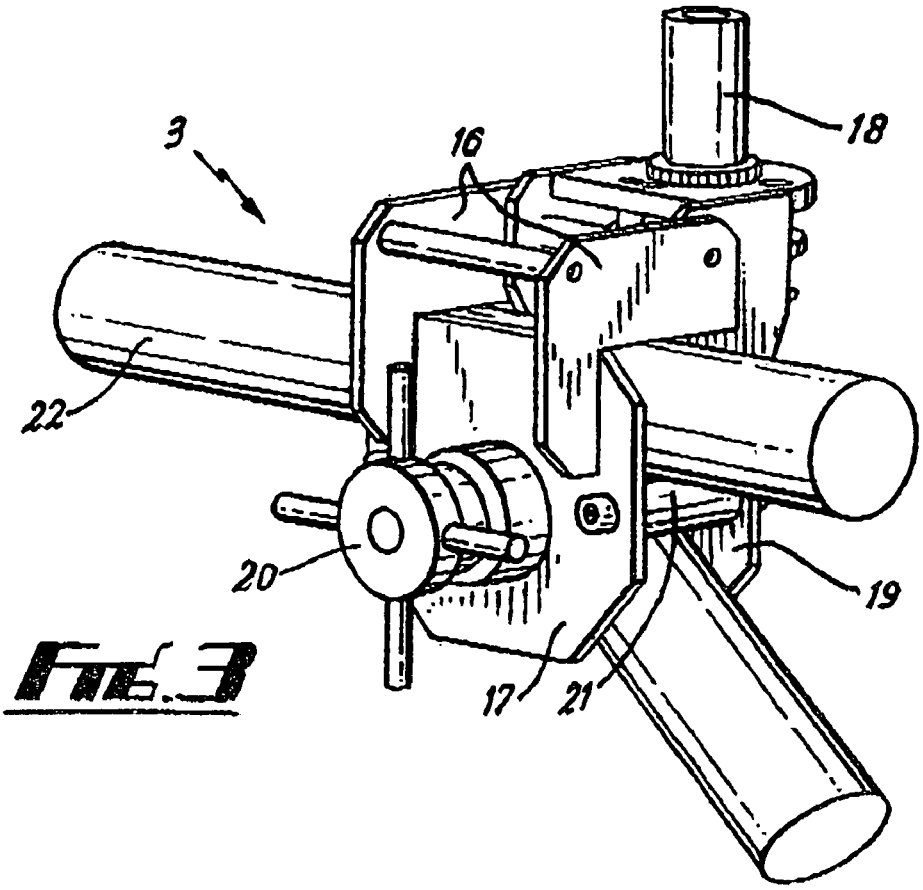
FIGS. 3 and 4 illustrate separate perspective views of a further component of the universal hose clamp, namely a universal base clamping mechanism shown clamped to a Y-shaped handrail.
Figure 4:
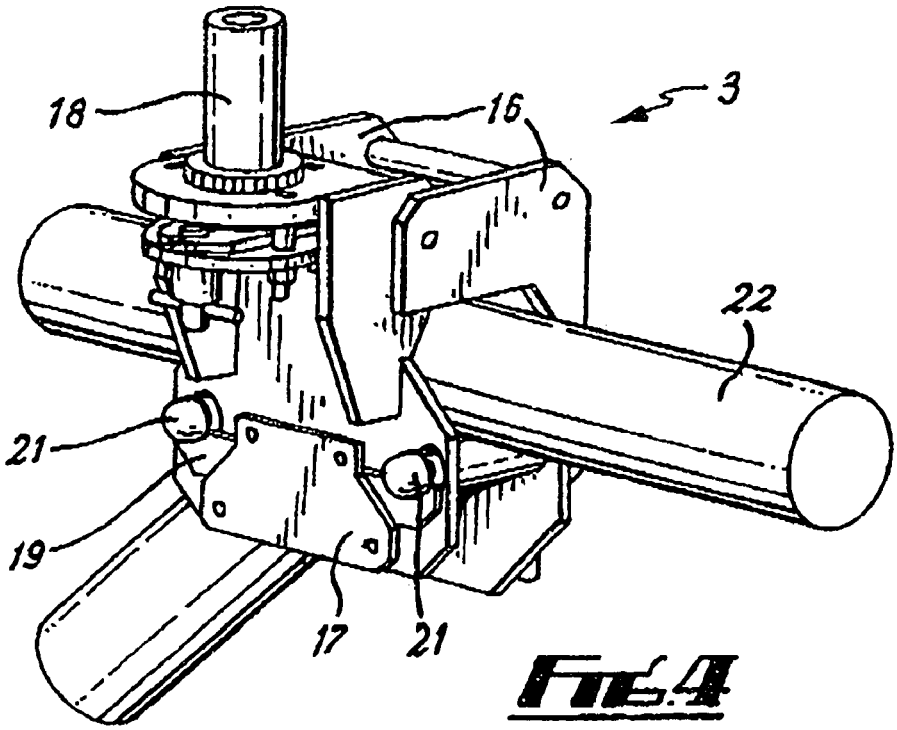

FIGS. 3 and 4 present further detail of the universal base clamping mechanism 3 in the absence of the hose locating mechanism 2. The base clamping mechanism 3 comprises a central frame 16, a rail clamp 17 and a female 18 for the azimuth locking mechanism 10. The rail clamp 17 further comprises a swing over lock 19, a rail clamp tightening assembly 20, and two threaded locating rails 21.

Figure 5:
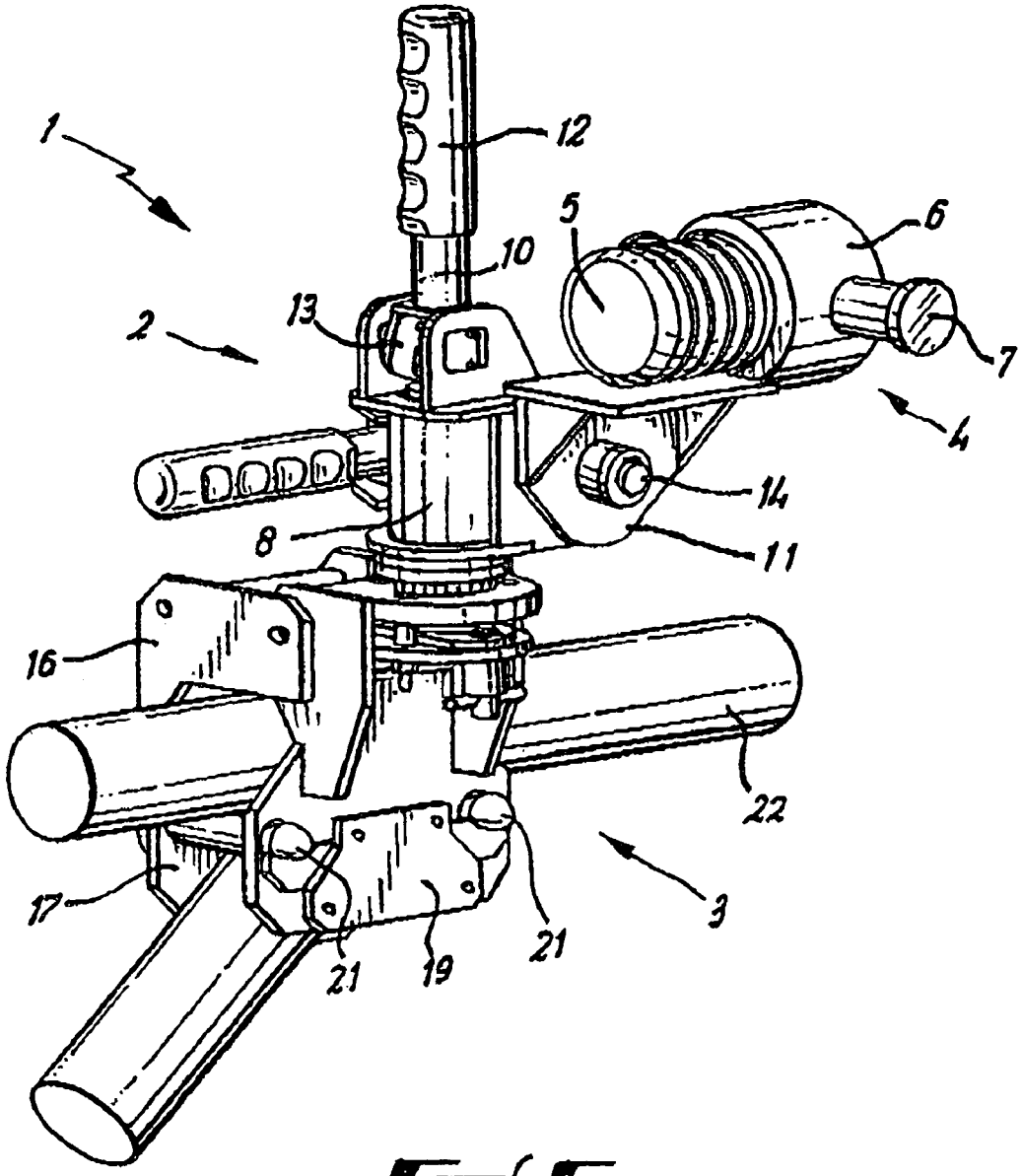
FIG. 5 illustrates the universal hose clamp of FIG. 1, with one of the universal azimuth locking mechanisms for controlling the hose clamp rotation about the vertical axis in the unlocked position.

The combination of the hose locating mechanism 2 and the base clamping mechanism 3 is achieved by inserting the stab pin 15 in the female locking component 18 with the handle assembly 12 in the unlocked position, as in FIG. 5. This unlocked position corresponds to the case when the handle assembly 12 is in a plane parallel to the stab pin 15. The locked position is achieved by rotating the handle assembly 12 through 90 degrees such that the handle assembly 12 now lies in the plane perpendicular to the stab pin 15, as in FIG. 1.

To employ the universal hose clamp 1, the base clamping mechanism 3 is attached to a railing, pole or other similarly reinforced structure. As shown in FIG. 1, the desired structure to which the hose clamp 1 can be attached may take the form of a Y-shaped rail 22. Initially the swing over lock 19 is opened by unscrewing one of the threaded locating rails 21. This allows the rail clamp 17 to be placed in situ around the hand rail 22. With the hand rail 22 in place above the threaded locating rails 21, the swing over lock 19 is then closed and fastened. The base clamping mechanism 3 is then secured in place by tightening of the rail clamp 17 by use of the rail clamp tightening assembly 20.

The second stage is to attach the hose locating mechanism 2 to the base clamping mechanism 3 via the vertical azimuth locking mechanism 10 as described above. Thereafter the hose (not shown) is inserted within the cylindrical hose gripping aid 5 which is then tightened in the cylindrical mounting band 6 that is attached to the quick release hose mount 11. The tightening of the cylindrical hose gripping aid 5 in the cylindrical mounting band 6 is achieved via the screw thread mechanism 7. With the horizontal azimuth locking mechanism 9 in the unlocked position the hose coupling 4 is mounted on the horizontal stab pin 14.

At this stage the hose is secured within the hose clamp 1 and can be deployed at full pressure by just one person. This has the obvious advantage of releasing manpower to carry out other important duties. By simply unlocking either of azimuth locking mechanisms, 9 and 10, the hose can be rotated to provide universal cover over $4\pi$ steradians.

Figure 6:
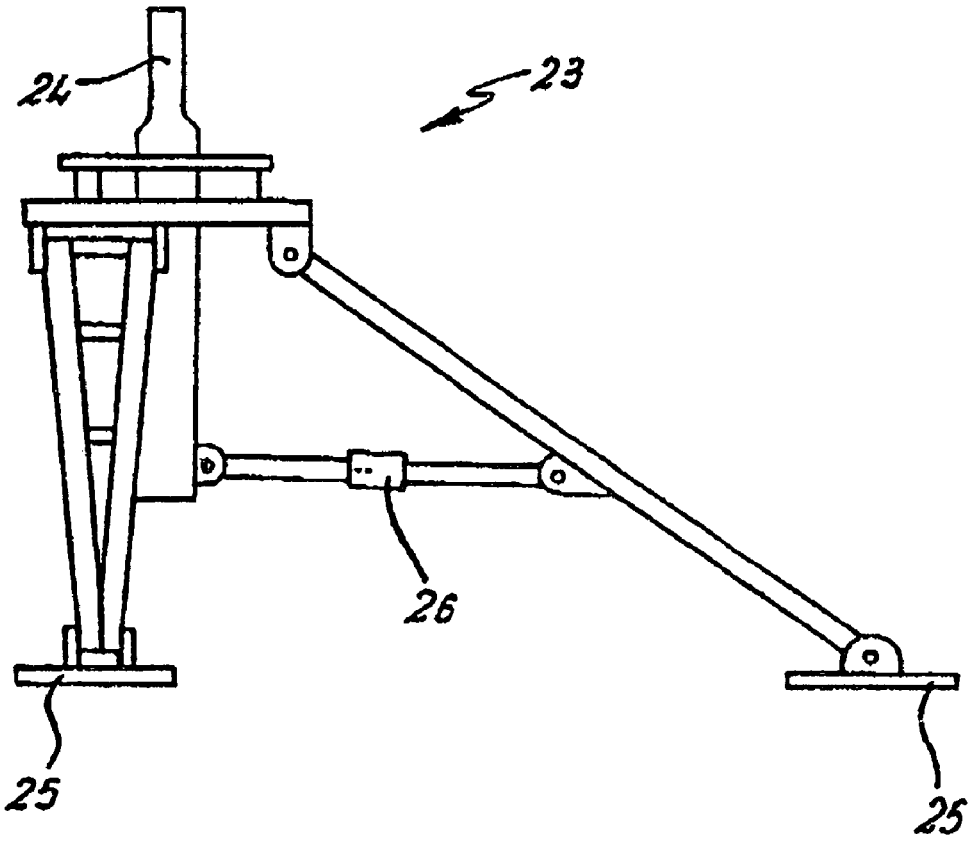
FIG. 6 illustrates a tripod on which the universal hose clamp of FIG. 1 can be mounted.

Mobility for the hose coupling 4 may be enhanced by its incorporation with a tripod system 23, as illustrated in FIG. 6. This tripod 23 comprises a female member 24 for use in an azimuth locking mechanism 10, adjustable legs 25 and a cross brace 26 to provide additional strength. It should be noted that the aforementioned female 24 is of a similar design to the female member 18 used in the previously described embodiment. Therefore, there is no requirement for the modification of the hose locating mechanism 2. With this embodiment the tripod is assembled at the required location. The hose (not shown) is then mounted in the hose locating mechanism 2 as previously described. The vertical stab pin 15 is then inserted in the female of the tripod 18 and locked as required by the vertical azimuth locking mechanism 10.

The use of alternative hose diameters is determined by the nature of the emergency. Thus the hose coupling 4 is not limited to use with one particular hose size. Selection of a hose can be accommodated within a particular cylindrical gripping aid 5 by the adjustment of the screw thread mechanism 7. If the hose diameter is significantly different then the quick release hose mount 11 allows a second hose clamp 4 of the desired dimensions to be quickly mounted on the hose locating mechanism 2.

An advantage of the present invention is that there is provided a universal hose clamp which can be used with known types of hose and whose parts are readily interchanged to meet the requirements of different emergency situations.

A further advantage of the present invention is that there is provided means which will reduce the manpower required to control a hose, and increase the numbers available to help those who are part of the emergency situation.

A further advantage of the invention is that the individual securing means are able to rotate such that the hose can be used in any direction thus allowing the changing needs of an emergency situation to be met.

In an alternative embodiment the clamp may be provided with means to enable control from a remote source. For example an electronic receiver and control electronics could be mounted within the central mount 8 of the universal hose locating mechanism 2. This would allow the direction of the hose coupling 4 to be altered without the requirement for direct human contact.

Further modifications and improvements may be added without departing from the scope of the invention herein intended.

What is claimed is:

1. A universal hose clamp comprising:

a universal hose locating mechanism;

a hose mount linked to the universal hose locating mechanism through a mounting pin to provide free rotational movement of the hose mount about the longitudinal axis of the mounting pin to control the pitch of the hose mount;

a first locking mechanism linked to the hose mount by the mounting pin, the first locking mechanism being movable between an unlocked position and a locked position to control rotational movement of the hose mount, the first locking mechanism comprising a handle assembly linked to the mounting pin, the handle assembly configured to rotate relative to the mounting pin to move the first locking mechanism between the unlocked and locked positions;

a securing means for securing the universal hose locating mechanism to a support structure; and a hose coupling coupled to the hose mount, the hose coupling being adapted to connect a hose to the universal hose locating mechanism, such that with the first locking mechanism in the unlocked position, the hose coupling has unlimited rotational movement about the longitudinal axis of the mount pin, wherein the universal hose locating mechanism further comprises a second locking mechanism linked to the hose mount, the second locking mechanism being movable between an unlocked and a locked position, the second locking mechanism comprising a second handle assembly and a swivel pin, wherein the swivel pin has a longitudinal axis that is substantially perpendicular to the longitudinal axis of the mounting pin, wherein the second handle assembly is rotatable relative to the swivel pin to move the second locking mechanism between the unlocked and locked positions such that with the second locking mechanism in the unlocked position, the hose coupling has unlimited rotational movement about the longitudinal axis of the swivel pin.

2. A universal hose clamp as claimed in claim 1, wherein the securing means comprises a female member adapted to receive an end of the swivel pin therein and a base clamping mechanism linked to the female member, the base clamping mechanism being suitable for clamping the universal hose clamp to a support structure such as a railing or pole.

3. A universal hose clamp as claimed in claim 1, wherein the securing means comprises a female member provided upon a portable independent frame, the female member being adapted to receive an end of the swivel pin therein to permit the securing means to be rotatable upon the portable independent frame.

4. A universal hose clamp as claimed in claim 3, wherein the portable independent frame is a tripod.

5. A universal hose clamp as claimed in claim 1, wherein the hose mount comprises a quick release having a female member adapted for receiving at least a portion of the mounting pin therein, wherein the hose mount is removable from the universal hose locating mechanism when the first locking mechanism is in the unlocked position.

6. A universal hose clamp as claimed in claim 2, wherein when the second locking mechanism is in the locked position the female member lockably engages with the swivel pin.

7. A universal hose clamp as claimed in claim 3, wherein when the second locking mechanism is in the locked position the female member lockably engages with the swivel pin.

8. A universal hose clamp as claimed in claim 5, wherein when the first locking mechanism is in the locked position the female member lockably engages with the mounting pin.

9. A universal hose clamp as claimed in claim 1, wherein the hose coupling further comprises a gripping aid, a mounting band coupled to the gripping aid and a hose securing means for securing a hose to the hose coupling, the hose securing means being coupled to the mounting band.

10. A universal hose clamp as claimed in claim 9, wherein the gripping aid is made of a flexible material comprising rubber.

11. A universal hose clamp as claimed in claim 9, wherein the gripping aid is cylindrical in shape.

12. A universal hose clamp as claimed in claim 9, wherein the mounting band is cylindrical in shape.

13. A universal hose clamp as claimed in claim 9, wherein the hose securing means is a screw thread mechanism.

14. A universal hose clamp comprising:

a universal hose locating mechanism;

a first locking mechanism linked to the universal hose locating mechanism, the first locking mechanism being movable between a locked and an unlocked position, the first locking mechanism comprising a handle assembly and a pin having a first axis, wherein the handle assembly rotates relative to the pin in a plane of the pin to move the first locking mechanism between the locked and unlocked positions;

a securing means for securing the universal hose locating mechanism to a support structure;

a hose coupling adapted to connect a hose to the universal hose locating mechanism, wherein the hose coupling is linked to the universal hose locating mechanism, such that the hose coupling has unlimited rotational movement about the first axis when the hose is coupled to the hose coupling and the first locking mechanism is in the unlocked position, wherein the hose coupling comprises a female member suitable for receiving the pin therein so as to allow the hose coupling to be removed from the universal hose locating mechanism when the first locking mechanism is in the unlocked position;

a second locking mechanism linked to the hose coupling, the second locking mechanism being movable between a locked and an unlocked position such that with the hose coupled to the hose coupling and the second locking mechanism in the unlocked position, the hose coupling has unlimited rotational movement about a second axis that is substantially perpendicular to the first axis, wherein the second locking mechanism comprises a second handle assembly and a connection means for connecting the second locking mechanism to a second pin;

wherein the first locking mechanism is in the unlocked position when the first handle assembly is substantially parallel to the first pin, and the locked position when the first handle assembly is rotated to lie substantially perpendicular to the first pin, and wherein second locking mechanism is in the unlocked positions when the second handle assembly is substantially parallel to the second pin, and the locked position when the second handle assembly is rotated to lie substantially perpendicular to the second pin.

15. A universal hose clamp comprising:

a universal hose locating mechanism;

a hose mount linked to the universal hose locating mechanism through a mounting pin to provide free rotational movement of the hose mount about the longitudinal axis of the mounting pin;

a first locking mechanism linked to the universal hose locating mechanism and the hose mount, the first locking mechanism being movable between an unlocked position and a locked position to control rotational movement of the hose mount, the first locking mechanism comprising a handle assembly configured to rotate relative to the mounting pin to move the first locking mechanism between the unlocked and locked positions;

a securing means for securing the universal hose locating mechanism to a support structure; and a hose coupling coupled to the hose mount, the hose coupling being adapted to connect a hose to the universal hose locating mechanism, such that with the first locking mechanism in the unlocked position, the hose coupling has unlimited rotational movement about the longitudinal axis of the mount pin; and a second locking mechanism linked to the universal hose locating mechanism and the hose mount, the second locking mechanism being movable between an unlocked position and a locked position, the second locking mechanism comprising a second handle assembly and a swivel pin linked thereto, wherein the swivel pin has a longitudinal axis that is substantially perpendicular to the longitudinal axis of the mounting pin, wherein the second handle assembly is rotatable relative to the swivel pin to move the second locking mechanism between the unlocked and locked positions, such that with the second locking mechanism in the unlocked position, the hose coupling has unlimited rotational movement about the longitudinal axis of the swivel pin.

16. A universal hose clamp comprising:

a universal hose locating mechanism;

a first locking mechanism linked to the universal hose locating mechanism, the first locking mechanism being movable between a locked and an unlocked position, the first locking mechanism comprising a handle assembly and a pin having a first axis, wherein the handle assembly rotates relative to the pin in a plane of the pin to move the first locking mechanism between the locked and unlocked positions;

a securing means for securing the universal hose locating mechanism to a support structure;

a hose coupling adapted to connect a hose to the universal hose locating mechanism, wherein the hose coupling is linked to the universal hose locating mechanism such that the hose coupling has unlimited rotational movement about the first axis when the hose is coupled to the hose coupling and the first locking mechanism is in the unlocked position;

a second locking mechanism linked to the hose coupling, the second locking mechanism being movable between a locked and an unlocked position such that with the hose coupled to the hose coupling and the second locking mechanism in the unlocked position, the hose coupling has unlimited rotational movement about a second axis that is substantially perpendicular to the first axis, wherein the second locking mechanism comprises a second handle assembly and a connection means for connecting the second locking mechanism to a second pin;

wherein the first locking mechanism is in the unlocked position when the first handle assembly is substantially parallel to the first pin, and the locked position when the first handle assembly is rotated to lie substantially perpendicular to the first pin, and wherein the second locking mechanism is in the unlocked positions when the second handle assembly is substantially parallel to the second pin, and the locked position when the second handle assembly is rotated to lie substantially perpendicular to the second pin;

wherein the securing means comprises a female member suitable for receiving the second pin therein and a portable independent frame configured to be linked to the female member.

* * * * *

UNITED STATES PATENT AND TRADEMARK OFFICE

CERTIFICATE OF CORRECTION

PATENT NO. : 7,159,826 B1
APPLICATION NO. : 10/019624
DATED : January 9, 2007
INVENTOR(S) : Terry Bruce It is certified that error appears in the above-identified patent and that said Letters Patent is hereby corrected as shown below:

On The Title Page
Assignee: remove [ (Item) (73) Assignee: Kennedys, Glasgow (GB) ]

Signed and Sealed this

Fourth Day of March, 2008

JON W. DUDAS
*Director of the United States Patent and Trademark Office*